US007155333B1

(12) United States Patent
Abram et al.

(10) Patent No.: US 7,155,333 B1
(45) Date of Patent: Dec. 26, 2006

(54) METHOD AND APPARATUS FOR CONTROLLING SOUND OF AN ENGINE BY SOUND FREQUENCY ANALYSIS

(75) Inventors: Kwin Abram, Columbus, IN (US); Joe Callahan, Greenwood, IN (US); Ivan Arbuckle, Columbus, IN (US); Robin Willats, Columbus, IN (US)

(73) Assignee: Arvin Technologies, Inc., Troy, MI (US)

( * ) Notice: Subject to any disclaimer, the term of this patent is extended or adjusted under 35 U.S.C. 154(b) by 0 days.

(21) Appl. No.: 11/219,083

(22) Filed: Sep. 2, 2005

(51) Int. Cl.
*F02D 45/00* (2006.01)

(52) U.S. Cl. ..... 701/111; 60/324

(58) Field of Classification Search ..... 701/111, 701/103, 105; 60/324; 381/71.1, 71.2, 71.3, 381/71.4, 71.5
See application file for complete search history.

(56) References Cited

U.S. PATENT DOCUMENTS

| | | | | |
|---|---|---|---|---|
| 5,608,633 A * | 3/1997 | Okada et al. | ..... | 701/111 |
| 5,655,367 A | 8/1997 | Peube et al. | ..... | 60/324 |
| 6,633,646 B1 * | 10/2003 | Hwang | ..... | 381/71.5 |
| 6,688,422 B1 * | 2/2004 | Fuesser et al. | ..... | 181/206 |
| 6,768,800 B1 * | 7/2004 | Enamito et al. | ..... | 381/71.5 |
| 6,940,983 B1 * | 9/2005 | Stuart | ..... | 381/71.4 |

FOREIGN PATENT DOCUMENTS

| | | |
|---|---|---|
| DE | 295 00 928.4 | 7/1995 |
| DE | 44 39 704 A1 | 5/1996 |
| DE | 44 39 705 A1 | 5/1996 |
| EP | 0 710 767 B1 | 4/2000 |
| FR | 2 613 089 | 9/1988 |
| WO | WO 94/01659 | 1/1994 |

* cited by examiner

*Primary Examiner*—Andrew M. Dolinar
*Assistant Examiner*—Johnny H. Hoang
(74) *Attorney, Agent, or Firm*—Barnes & Thornburg LLP

(57) ABSTRACT

An apparatus for controlling sound of an engine comprises a sound sensor, an exhaust valve, and a controller. The controller is configured to determine a sound level of a peak sound frequency within a predetermined sound frequency range by use of output from the sound sensor, compare the sound level of the peak sound frequency to a predetermined sound level, and change the position of the exhaust valve based on the comparison between the sound level of the peak sound frequency and the predetermined sound level. An associated method is disclosed.

20 Claims, 2 Drawing Sheets

29

| Cylinders | $SL_{set}$ |
|---|---|
| 4 | x |
| 6 | y |
| 8 | z |

METHOD AND APPARATUS FOR CONTROLLING SOUND OF AN ENGINE BY SOUND FREQUENCY ANALYSIS

FIELD OF THE DISCLOSURE

The present disclosure relates to methods and apparatus for controlling sound generated by an engine.

BACKGROUND OF THE DISCLOSURE

Internal combustion engines typically generate sound as a result of the combustion process. Many acoustic devices such as, for example, mufflers and resonators have been developed to address this issue.

SUMMARY OF THE DISCLOSURE

According to an aspect of the present disclosure, there is provided an apparatus for controlling sound generated by an engine. The apparatus comprises a sound sensor, an exhaust valve, and a controller. The controller is configured to determine a sound level of a peak sound frequency within a predetermined sound frequency range by use of output from the sound sensor, compare the sound level of the peak sound frequency to a predetermined sound level, and change the position of the exhaust valve based on the comparison between the sound level of the peak sound frequency and the predetermined sound level. An associated method is disclosed.

The above and other features of the present disclosure will become apparent from the following description and the attached drawings.

DETAILED DESCRIPTION OF THE DRAWINGS

Figure 1:
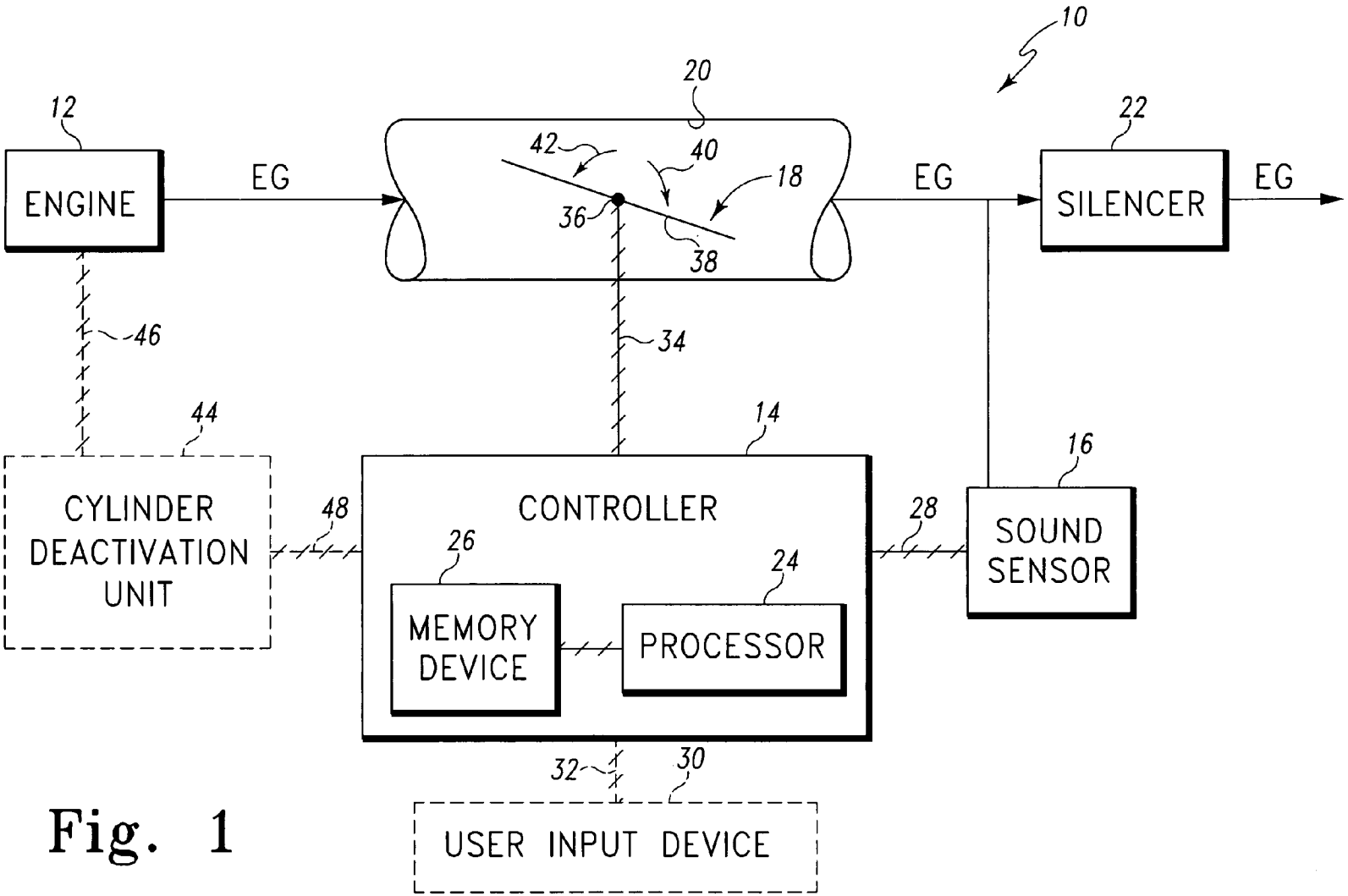
FIG. 1 is a simplified block diagram showing an apparatus for controlling sound generated by an engine.

While the concepts of the present disclosure are susceptible to various modifications and alternative forms, specific exemplary embodiments thereof have been shown by way of example in the drawings and will herein be described in detail. It should be understood, however, that there is no intent to limit the disclosure to the particular forms disclosed, but on the contrary, the intention is to cover all modifications, equivalents, and alternatives following within the spirit and scope of the invention as defined by the appended claims.

Referring to FIG. 1, there is shown an apparatus 10 for controlling sound of an engine 12 as a result of the combustion process in the engine 12. The apparatus 10 comprises a controller 14 electrically coupled to a sound sensor 16 configured to sense sound generated by the engine 12 and an exhaust valve 18 mounted for movement in an exhaust passageway 20 that conducts exhaust gas ("EG") of the engine 12 to a silencer 22 (e.g., muffler and/or resonator). The controller 14 comprises a processor 24 and a memory device 26 that is electrically coupled to the processor 24 and has stored therein a plurality of instructions which, when executed by the processor 24, cause the processor 24 to determine a sound level of a peak sound frequency within a predetermined sound frequency range by use of output from the sound sensor 16, compare the sound level of the peak sound frequency to a predetermined sound level, and change the position of the exhaust valve 18 based on the comparison between the sound level of the peak sound frequency and the predetermined sound level. The apparatus 10 is thus able to adjust the sound quality emitted from the exhaust system of the engine 12.

Operation of the engine 12 generates a complex pressure pulsation wave in the exhaust gas. The sound sensor 16 is configured to sense this pressure pulsation wave. To do so, the sound sensor 16 is exemplarily coupled to the passageway 20. Illustratively, the sound sensor 16 is coupled to the passageway 20 downstream from the valve 18. It is to be understood that the sensor 16 may be coupled to the passageway 20 upstream from the valve 18. In other examples, there may be more than one sensor 16. Further, the sensor(s) 16 may be positioned to take sound level readings at locations other than or in addition to the passageway 20 such as in the passenger cabin of the vehicle. In any case, the sensor(s) 16 send a signal to the controller 14 over an electrical line 28.

At the controller 14, the processor 24 operates in response to instructions stored in the memory device 26. In particular, the processor 24 transforms the signal from the time domain to a frequency domain (e.g., by a Fourier transformation, a LaPlace transformation, or a Z transformation) for analysis of the frequency content of the pressure pulsation wave. The processor 24 could also transform the time signal from the initial unfiltered state to a filtered time domain state via a time domain filter (e.g., FIR filter with tracking characteristics) for analysis of the signal in the time domain via a variety of methods (e.g., RMS, Peak to Peak) to determine the magnitude of a particular pressure pulsation wave in a particular frequency range.

Figures 2, 3:
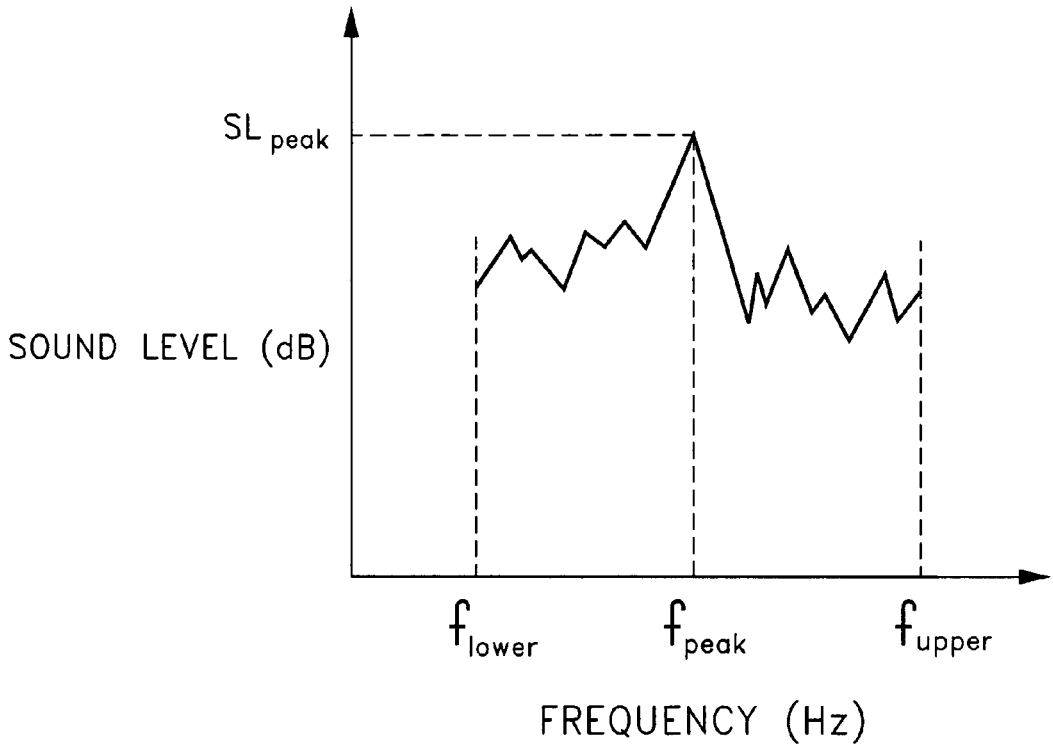
FIG. 2 is a graph relating sound level to sound frequency.
FIG. 3 is a data table relating a predetermined sound level to the number of operational cylinders of an engine.

Referring to FIG. 2, there is shown a simplified graphical representation of the sound frequency content of an exemplary pressure pulsation wave within a predetermined sound frequency range. The predetermined sound frequency range is defined between a lower frequency, $f_{lower}$, and an upper frequency, $f_{upper}$, and is selected so as to correspond to the sound frequencies of interest for a given configuration of the engine 12 such as the number of operational cylinders of the engine 12. For example, if the engine 12 has four operational cylinders, $f_{lower}$, and $f_{upper}$ may be 30 Hz and 100 Hz, respectively. If the engine 12 has six operational cylinders, $f_{lower}$ and $f_{upper}$ may be 45 Hz and 150 Hz, respectively. If the engine 12 has eight operational cylinders, $f_{lower}$ and $f_{upper}$ may be 60 Hz and 200 Hz, respectively. Such predetermined sound frequency ranges are representative of at least a portion of the operating range of the engine 12 (e.g., between idle and an intermediate engine operating speed).

The processor 24 evaluates the frequency content within the predetermined sound frequency range and identifies the peak sound frequency ($f_{peak}$) within that range. This peak sound frequency is considered to be a reasonable estimation of the firing frequency of the engine 12 (i.e., the fundamental firing frequency or harmonic thereof).

After identifying the peak sound frequency within the predetermined sound frequency range, the processor 24 determines the sound level ($SL_{peak}$) of the peak sound frequency. The sound level is, for example, the sound pressure level (quantifiable, for example, in decibels, dB) of the peak sound frequency.

Referring to FIG. 3, there is shown a data table 29 stored in the memory device 26. The data table 29 provides a predetermined sound level ($SL_{set}$) for the number of operational engine cylinders. Illustratively, the data table 29 stores a predetermined sound level for each of a 4-cylinder engine configuration, a 6-cylinder engine configuration, and an 8-cylinder engine configuration, which may be particularly useful when the engine 12 is operable according to a cylinder deactivation scheme. Each predetermined sound level may be stored in the memory device 26 at the time of manufacture of the controller 14 as a default value. Alternatively, there may be a user input device 30 electrically coupled to the controller 14 via an electrical line 32 for a user to "customize" the predetermined sound level by using the device 30 to enter into the memory device 26 a sound level different from the default value in order to achieve a sound quality preferred by the user.

The processor 24 queries the data table 29 and retrieves the predetermined sound level corresponding to the number of operational engine cylinders. Next, the processor 24 compares the sound level of the peak sound frequency to the retrieved predetermined sound level. Exemplarily, the processor 24 determines the difference between the sound level of the peak sound frequency and the predetermined sound level.

Referring back to FIG. 1, the processor 24 moves the valve 18 in a direction and to an extent based on the polarity and the magnitude, respectively, of the calculated difference between the sound level of the peak sound frequency and the predetermined sound level. If the peak sound level is greater than the predetermined sound level, the processor 24 sends a signal over an electrical line 34 to an actuator 36 of the valve 18 to cause a rotatable flapper 38 of the valve 18 to rotate in a closing direction 40 by an amount corresponding to the magnitude of the difference to reduce the peak sound level to about the predetermined sound level. If the peak sound level is less than the predetermined sound level, the controller 14 may be programmed to cause the processor 24 to send a signal over the line 34 to the actuator 36 to cause the flapper 38 to rotate in an opening direction 42 by an amount corresponding to the magnitude of the difference to increase the peak sound level to about the predetermined sound level. Specific sound quality targets may thus be achieved by such a controller logic configuration.

According to another example, the processor 24 may not move the flapper 28 at all if the peak sound level is below the predetermined sound level. This would be useful in the case where engine noise suppression is the main objective. The particular algorithm implemented depends on the sound quality desired to be achieved.

The comparison between the peak sound level and the predetermined sound level is thus used to establish the new position of the valve 18. In particular, the comparison is used to establish the new angular position of the flapper 38. As such, the valve 18 is movable within a valve position range comprising a number (e.g., at least three) of possible valve positions for the valve 18. Indeed, the valve position range may be a continuous range of valve positions. The valve 18 may thus be varied to assume any of these positions to adjust the sound level of the peak sound frequency.

As alluded to above, the engine 12 may be operated according to a cylinder deactivation scheme. As such, a cylinder deactivation unit 44 may be included to communicate with the engine 12 over an electrical line 46 to change the number of operational engine cylinders of the engine 12 and to communicate the number of operational engine cylinders to the controller 14 over an electrical line 48. Since the predetermined sound frequency range is based on the number of operational engine cylinders, changing the number of operational engine cylinders changes the predetermined sound frequency range to be analyzed by the controller 14. In addition, the default predetermined sound level is changed upon changing the number of operational engine cylinders.

For example, if the number of operational engine cylinders is changed from a first number (e.g., four, six, or eight) to a second number (e.g., four, six, or eight), the predetermined sound frequency range is changed from a first range corresponding to the first number of operational engine cylinders to a second range different from the first range and corresponding to the second number of operational engine cylinders. In addition, the predetermined sound level is changed from a first predetermined sound level corresponding to the first number of operational engine cylinders to a second predetermined sound level different from the first predetermined sound level and corresponding to the second number of operational engine cylinders.

It is within the scope of this disclosure for the controller 14 to receive a number of inputs. As mentioned above, the inputs may come from the sensor(s) 16, the input device 30, and the cylinder deactivation unit 44. In addition, the controller 14 may receive inputs in the form of signals sent from the engine control module, emissions transducers, thermocouples, etc. Further, each of the controller 14 and the cylinder deactivation unit 44 may be incorporated into the engine control unit or may be configured as a stand-alone device.

It is further within the scope of this disclosure to configure the valve 18 and the silencer 22 according to any of the arrangements set forth in International Application No. PCT/US2005/016701, the disclosure of which is hereby incorporated by reference herein.

While the concepts of the present disclosure have been illustrated and described in detail in the drawings and foregoing description, such illustration and description is to be considered as exemplary and not restrictive in character, it being understood that only illustrative embodiments have been shown and described and that all changes and modifications that come within the spirit of the disclosure are desired to be protected.

There are a plurality of advantages of the concepts of the present disclosure arising from the various features of the systems described herein. It will be noted that alternative embodiments of each of the systems of the present disclosure may not include all of the features described yet still benefit from at least some of the advantages of such features. Those of ordinary skill in the art may readily devise their own implementations of a system that incorporate one or more of the features of the present disclosure and fall within the spirit and scope of the invention as defined by the appended claims.

The invention claimed is:

1. A method of controlling sound of an engine, comprising the steps of:

determining a sound level of a peak sound frequency within a predetermined sound frequency range, comparing the sound level of the peak sound frequency to a predetermined sound level, and changing the position of an exhaust valve based on the comparing step.

2. The method of claim 1, wherein the determining step comprises monitoring output of a sound pressure sensor and transforming the output from the time domain to a frequency domain.

3. The method of claim 1, wherein the determining step comprises sensing a pressure pulsation wave of exhaust gas of the engine.

4. The method of claim 1, wherein the comparing step comprises querying a data table to determine the predetermined sound level based on the number of operational engine cylinders of the engine.

5. The method of claim 1, wherein the comparing act comprises determining the difference between the sound level of the peak sound frequency and the predetermined sound level.

6. The method of claim 1, wherein the changing step comprises varying the position of the exhaust valve within a continuous range of valve positions.

7. The method of claim 1, wherein:

the comparing step comprises determining the difference between the sound level of the peak sound frequency and the predetermined sound level, and the changing step comprises moving the exhaust valve in a direction and to an extent corresponding to the polarity and magnitude, respectively, of the difference between the sound level of the peak sound frequency and the predetermined sound level.

8. The method of claim 7, wherein the moving step comprises (i) moving the exhaust valve in a closing direction so as to decrease the sound level of the peak sound frequency if the sound level of the peak sound frequency is greater than the predetermined sound level and (ii) moving the exhaust valve in an opening direction so as to increase the sound level of the peak sound frequency if the sound level of the peak sound frequency is less than the predetermined sound level.

9. The method of claim 1, further comprising determining the predetermined sound frequency range based on the number of operational engine cylinders of the engine.

10. The method of claim 9, further comprising changing the number of operational engine cylinders of the engine from a first number of engine cylinders to a second number of engine cylinders different from the first number, wherein the step of determining the predetermined sound frequency range comprises changing the predetermined sound frequency range from a first range to a second range different from the first range such that the first range corresponds to the first number of engine cylinders and the second range corresponds to the second number of engine cylinders.

11. The method of claim 1, further comprising changing the predetermined sound level.

12. An apparatus for controlling sound of an engine, comprising:

a sound sensor configured to sense sound generated by the engine, an exhaust valve, and a controller electrically coupled to the sound sensor and the exhaust valve, the controller comprising (i) a processor, and (ii) a memory device electrically coupled to the processor, the memory device having stored therein a plurality of instructions which, when executed by the processor, cause the processor to:

determine a sound level of a peak sound frequency within a predetermined sound frequency range by use of output from the sound sensor, compare the sound level of the peak sound frequency to a predetermined sound level, and change the position of the exhaust valve based on the comparison between the sound level of the peak sound frequency and the predetermined sound level.

13. The apparatus of claim 12, wherein the sound sensor is positioned to sense a pressure pulsation wave of exhaust gas of the engine.

14. The apparatus of claim 12, wherein the plurality of instructions, when executed by the processor, cause the processor to transform the output of the sound sensor from the time domain to a frequency domain.

15. The apparatus of claim 12, wherein the plurality of instructions, when executed by the processor, cause the processor to query a data table to determine the predetermined sound level based on the number of operational engine cylinders of the engine.

16. The apparatus of claim 12, wherein the plurality of instructions, when executed by the processor, cause the processor to move the exhaust valve in a closing direction if the sound level of the peak sound frequency is greater than the predetermined sound level.

17. The apparatus of claim 12, wherein the plurality of instructions, when executed by the processor, cause the processor to move the exhaust valve in an opening direction if the sound level of the peak sound frequency is less than the predetermined sound level.

18. The apparatus of claim 12, wherein the plurality of instructions, when executed by the processor, cause the processor to vary the position of the exhaust valve within a valve position range comprising at least three valve positions.

19. The apparatus of claim 12, wherein the plurality of instructions, when executed by the processor, cause the processor to determine the predetermined sound frequency range based on the number of operational engine cylinders of the engine.

20. The apparatus of claim 12, further comprising a cylinder deactivation unit that is configured to change the number of operational engine cylinders of the engine from a first number to a second number different from the first number and that is electrically coupled to the controller, wherein the plurality of instructions, when executed by the processor, cause the processor to change the predetermined sound frequency range from a first range corresponding to the first number of operational engine cylinders to a second range different from the first range and corresponding to the second number of operational engine cylinders in response the cylinder deactivation unit changing the number of operational engine cylinders from the first number to the second number.

* * * * *